US005876317A

United States Patent [19]

Sigrist et al.

[11] Patent Number: 5,876,317

[45] Date of Patent: Mar. 2, 1999

[54] METHOD AND APPARATUS FOR PREPARING BLANKS

[75] Inventors: Albert Sigrist, Colombier; Roberto Rizzolo, Cham du Moulin, both of Switzerland

[73] Assignee: Philip Morris Incorporated, New York, N.Y.

[21] Appl. No.: 502,950

[22] Filed: Jul. 17, 1995

[30] Foreign Application Priority Data

Jul. 19, 1994 [EP] European Pat. Off. ..... 94810424

[51] Int. Cl.[6] ..... B65B 19/22

[52] U.S. Cl. ..... 493/22; 493/29; 493/62

[58] Field of Search ..... 493/3, 8, 10, 11, 493/22, 24, 29, 13, 14, 17, 18, 74, 910, 923, 932, 9, 21, 25, 30, 34, 64, 62

[56] References Cited

U.S. PATENT DOCUMENTS

| | | | |
|---|---|---|---|
| 2,984,384 | 5/1961 | Chalmers et al. . | |
| 3,537,359 | 11/1970 | Finke . | |
| 3,667,354 | 6/1972 | Steinmetz . | |
| 3,833,446 | 9/1974 | Class . | |
| 4,011,708 | 3/1977 | Brown . | |
| 4,023,470 | 5/1977 | Van der Meulen . | |
| 4,070,951 | 1/1978 | Bala . | |
| 4,097,039 | 6/1978 | Fischer . | |
| 4,182,225 | 1/1980 | Reid . | |
| 4,216,705 | 8/1980 | Achelphohl . | |
| 4,231,560 | 11/1980 | Stohlquist | 493/29 |
| 4,287,797 | 9/1981 | Seragnoli . | |
| 4,380,446 | 4/1983 | Dickson | 493/11 |
| 4,571,231 | 2/1986 | Rudzinat | 493/11 |
| 4,648,858 | 3/1987 | Lewis | 493/4 |
| 4,702,731 | 10/1987 | Lambrecht | 493/196 |
| 4,781,090 | 11/1988 | Feldkamper . | |
| 4,934,993 | 6/1990 | Gietman | 493/11 |
| 5,112,289 | 5/1992 | Kohn | 493/194 |
| 5,292,299 | 3/1994 | Anderson | 493/11 |
| 5,421,802 | 6/1995 | Landeck . | |
| 5,555,786 | 9/1996 | Fuller | 83/663 |

FOREIGN PATENT DOCUMENTS

| | | |
|---|---|---|
| 0 633 201 A1 | 7/1993 | European Pat. Off. . |
| 1158865 | 6/1958 | France . |
| 29 15 829 A1 | 4/1979 | Germany . |
| 31 24 344 A1 | 6/1981 | Germany . |
| 31 41 311 A1 | 10/1981 | Germany . |
| 33 22 129 A1 | 6/1983 | Germany . |
| 2088340 | 11/1981 | United Kingdom . |

*Primary Examiner*—John Sipos
*Assistant Examiner*—Christopher W. Day
*Attorney, Agent, or Firm*—James T. Moore; James E. Schardt; Charles E.B. Glenn

[57] ABSTRACT

A method and apparatus are provided for preparing discrete blanks from a wound strip comprising a plurality of connected blanks. Each blank has a determined separation point and a marker at a determined distance from the determined separation point for making soft-type wrappers. First, the wound strip is unwound under tension. Next, at least a section of a particular blank of the unwound strip is cut and any other milling and preparatory steps are performed by appropriate rollers and mechanisms. The tension of the unwound strip is slackened periodically, e.g., via chocking these rollers, and the unwound strip is realigned relative to the marker of the particular blank during this slackening, e.g, by identifying the marker via a sensor and driving the strip via rollers. The particular blank of the realigned strip is separated at the determined separation point of the particular blank to separate the particular blank from the realigned strip.

7 Claims, 2 Drawing Sheets

METHOD AND APPARATUS FOR PREPARING BLANKS

PRIORITY APPLICATION

The present application claims priority from European patent application 94 810 424.5, filed Jul. 19, 1994, which is hereby incorporated by reference in its entirety.

BACKGROUND OF THE INVENTION

Technical Field of the Invention

The present invention relates to a methods and apparatuses for preparing blanks, especially blanks for wrapping packs of cigarettes.

Discussion of the Related Art

Two main types of cigarette packs are known, the box or stiff pack generally known by the name of hinged-lid pack and the soft pack. Each of these two types of packs have reciprocal advantages and drawbacks, both at the time of preparation of the packs and at the time of their use.

Generally, the blanks for box packs are prepared independently of the cigarette packing machine, sometimes even by a specialized manufacturer, independent of the tobacco industry. They are delivered in stacks of blanks, each of them comprising the fold ribs and the cuts necessary for assembling them on the packing machine. As concerns the blanks for soft packs, they are generally intended to form packs by diamond-folds which do not require previous cuts of the blank. Hence, these blanks are obtained starting from a strip coming from a preprinted roll directly feeding the packing machine.

Other types of blanks for soft packs are intended to form packs comprising flat folds and not solely diamond folds. For this purpose, it is necessary to make cuts on the blanks, these cuts being rather similar to those provided on a blank for a box pack. However, in view of the low weight of the paper, typically 90–100 g/sq.m., it is not possible to prepare the blanks separately as for those intended for the box packs. Blanks of such thin paper comprising cuts are difficult to separate from one another when they are disposed in stacks, leading to jamming of the packing machine.

A prior machine is represented by DE-A-31 41 311 [GB-A-2,088,340]. The device described in this document shows a system for feeding a strip of a material intended for making a package, a cut being made periodically in the strip in order to make blanks. As described, this device requires stopping of the strip at the moment of cutting the blank, which brings about a reduction of the output of the machine as well as strong jolts to the strip.

Generally, in view of the low stiffness of the paper used, the conventional soft-type blanks do not comprise grooves permitting the making of folds to be facilitated at the time of assembly of the pack. Such grooves may, however, be useful for facilitating the making of the folds, for increasing the rigidity of the folds and for improving the attractiveness of the finished pack.

OBJECTS OF THE INVENTION

A first object of the present invention is therefore to provide a process permitting a transverse cut to be carried out precisely in order to separate a blank from a strip of paper.

A second object of the present invention is to provide a device intended to be installed on a cigarette packing machine, the device being fed by a strip of paper and carrying out at least one or more cuts at the time of the passage of the strip in the device, in such a way that it is subsequently possible to separate the blank precisely from the strip of paper in order to produce a soft-type package, comprising one or more flat folds, on the packing machine.

Another object of the present invention is to provide fold grooves to a soft-type blank.

It may be of interest, in view of the presence of this device, to add to it still other elements permitting the blank to be enhanced in order the improve the preparation or the use of the pack. Among these elements, there may be mechanisms permitting milled or embossed lines to be made in order to facilitate holding of the pack as well as opening it, and/or mechanisms permitting a date or code to be placed on each blank, as well as mechanisms permitting the device or devices for opening the pack to be prepared.

A further object of the present invention is to add one or more of the above mechanisms to the preceding device and to make the preceding device modular, so as to be able to adapt it to different types of blanks.

Another object of the present invention is to facilitate the synchronization of the various mechanisms above.

A further object of the present invention is to propose a compact device capable of being installed originally on a new packing machine or of being added subsequently to an existing machine.

SUMMARY OF THE INVENTION

In order to achieve the mentioned objects, a method and apparatus are provided for preparing discrete blanks from a wound strip comprising a plurality of connected blanks. Each blank has a determined separation point and a marker at a determined distance from the determined separation point for making soft-type wrappers. First, the wound strip is unwound under tension. Next, at least a section of a particular blank of the unwound strip is cut and any other milling and preparatory steps are performed by appropriate rollers and mechanisms. The tension of the unwound strip is slackened periodically, e.g., via chocking these rollers, and the unwound strip is realigned relative to the marker of the particular blank during this slackening, e.g., by identifying the marker via a sensor and driving the strip via rollers. The particular blank of the realigned strip is separated at the determined separation point of the particular blank to separate the particular blank from the realigned strip.

BRIEF DESCRIPTION OF THE DRAWING

The invention is described below referring to the drawing comprising the figures in which.

DETAILED DESCRIPTION OF THE PREFERRED EMBODIMENTS

Figure 1:
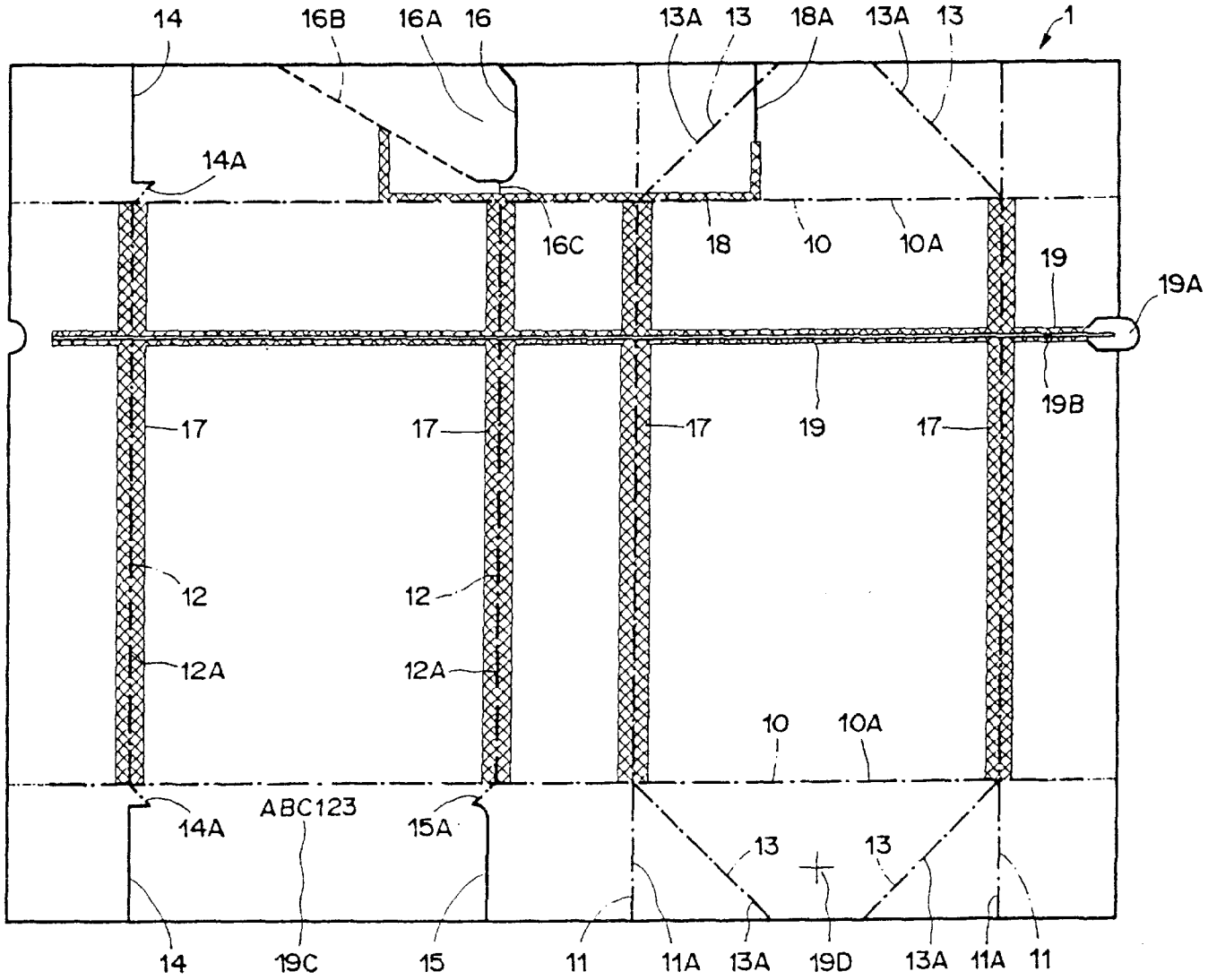
FIG. 1 shows a particular embodiment of a blank produced by the preparation device according to the present invention.

A device (2) is provided, intended to be installed directly on the packing machine (3) and grouping in a compact unit (20) several elementary mechanisms (4, 5, 6, 7) permitting various operations to be carried out for preparing the blank, such as cuts (14, 15, 16), fold grooves (11A, 12A, 13A, 14A, 15A, 16C), one or more milled lines (17, 18), as well as the preparation of the mechanism for opening the pack (16A, 19A). Owing to the modularity of the various elementary mechanisms, it is easy to pass from the fabrication of one type of blank to another. Mechanisms (8, 42, 80, 81) are provided in order to synchronize the various elementary mechanisms and to effect a last transverse cut for separating the blanks at a very exactly determined location.

The term fold ribs as used is to be understood as a deformation carried out at the location where the fold will be made or on a fold line. This deformation may be in relief either on the face of the blank corresponding to the outside of the fold and consequently hollowed on the opposite face, or on the contrary in relief on the face corresponding to the inside of the fold and hollowed on the opposite face. On the faces where this deformation is hollowed, it then corresponds to a groove. Hereafter, reference will be made only to fold ribs, covering one or the other of the above meanings.

The blank 1 of FIG. 1 is only one particular embodiment of a blank for wrapping a soft-type cigarette pack which groups a number of elements producible by the preparation device according to the present invention. It is to be noted that those skilled in the art will know how to adapt such a device for preparing packaging blanks to products other than cigarettes. The disclosed blank embodiment and other blanks are discussed further in commonly assigned, copending U.S. patent application Ser. No. 08/271,396, which is hereby incorporated by reference in its entirety, claiming priority from European published patent application EP 0 633 201 A1 filed Jul. 6, 1993. The blank 1 is generally of an essentially rectangular shape and is composed of panels separated especially by fold lines 10, 11, 12, 13 in order to form the side faces, as well as the lower and upper faces, of the pack. In relation to a blank intended for making a usual soft pack, this one is prepared especially so that two of the panels forming the upper and lower faces may be folded flat. For this purpose, the blank 1 includes the cuts 14, 15, and 16. The ends of the cuts 14 and 15 close to the fold lines 10 may end in a portion at 90°, as on the cuts 14, or in an arcuate portion, as on the cut 15. By joining the ends of these portions of cuts to the corresponding fold line by a fold-line portion 14A, 15A, it is possible to create the start of a diamond-fold at the time of assembly of the pack, which improves its fluid tightness despite the flat folding of the upper and lower panels.

The cut 16 is of a different shape here seeing that it also constitutes one of the mechanisms of opening the pack. For this purpose, cut 16 is continued by a partial cut 16B in order to form the tearing tongue 16A. The fold-line portion 16C has the same function as that described previously for the other cuts.

In addition to the cuts described above, the device according to the present invention can provide a number of fold grooves, especially two longitudinal grooves 10A corresponding to the fold lines 10, four transverse grooves 11A, 12A corresponding to the fold lines 11 and 12, as well as possible oblique grooves 13A for the fold lines 13 necessary for a diamond-fold of certain portions of the pack. The short fold lines 14A, 15A, and 16C mentioned previously may also each receive a short fold groove.

Other fittings may be added to the blank 1, for example as milled lines. Milling is understood here to mean an operation by which a wheel or roller comprising a certain ridged or fluted shape at its circumference is cold-pressed on a portion of the blank, creating a weakened zone, a cold-milled line or cold-embossed line, thus facilitating its folding or tearing. In order to simplify the terminology, reference will be made to milling and milled line hereafter.

The transverse fold lines 11 and 12 may be milled, as shown at 17, on their central portion bounded by the fold lines 10. This operation may be carried out in lieu of or in addition to the creation of the grooves 12A. By this operation, a pack may be obtained, the four side corners of which are rounded, thus improving its attractiveness and rigidity.

Another milled line may be created as shown at 18 in order to facilitate opening of the upper face of the pack. The portion of the milled line 18 shown superimposed on the fold line 10 may be superimposed on that line or else shifted by a few mm toward the panels forming the side faces of the pack. The end of this milled line 18 may end in a cut 18A or else continue up to the edge of the blank.

In case an opening for the side faces of the pack is to be provided, the device according to the invention further comprises mechanism for permitting a longitudinal milled line 19 to be created, a tear string or tape 19B to be added to it, and a U-shaped cut to be made in the side edge of the blank in order to create a tearing tongue 19A. Note the hollowed cut on the opposite edge of the blank. Also, mechanisms for imprinting of a date or an alphanumeric code or bar code 19C may be added to the device of the present invention.

As is seen in FIG. 1, the longitudinal fold grooves 10A and the milled line 19 do not extend over the whole length of the blank 1 but stop a few mm away from the side edges for a reason which will be explained below.

Figure 2:
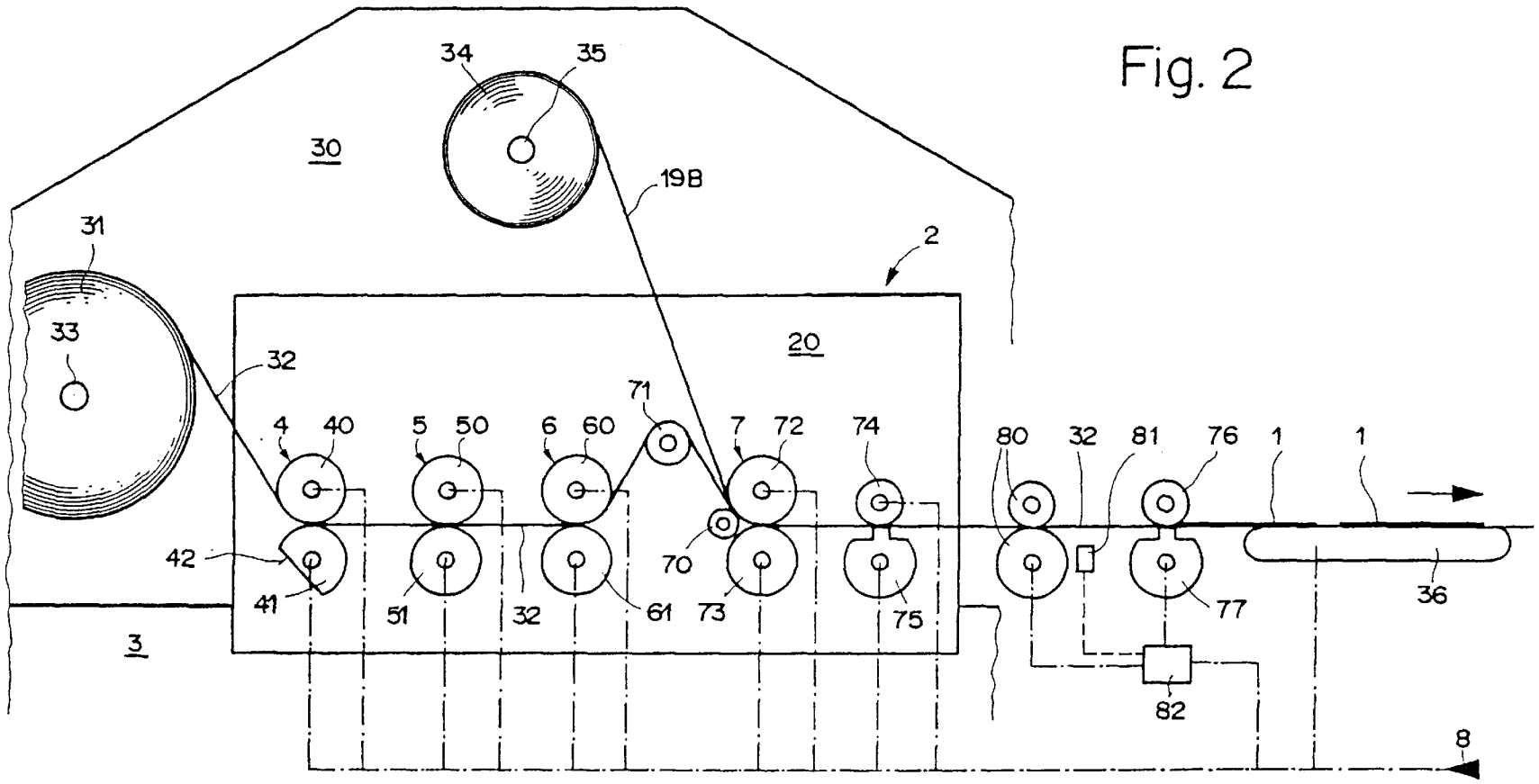
FIG. 2 shows a diagrammatic view of an embodiment of the device for preparing blanks according to the present invention.

As is seen in FIG. 2, the blank-preparation device 2, permitting the operations described above to be carried out, is preferably installed directly on a cigarette packing machine 3 comprising a frame 30, only a portion of which is visible in FIG. 2.

The preparation device 2 includes mainly an infrastructure 20 on which the various mechanisms permitting these described operations are mounted. A reel 31 of a continuous strip 32 of paper of a weight corresponding to the production of a soft pack, e.g., typically 90–100 g/sq.m. and one face of which is already imprinted periodically reproducing the motif or motifs which will subsequently appear on the outside face of the pack, is rotating on a shaft 33 fixed either to a portion 30 of the frame of the packing machine or to a portion of the infrastructure 20. The rotation of the reel 31 is slightly braked in order to keep the strip 32 taut. The tear string or tape 19B, of which mention has previously been made, comes from another reel 34, rotating braked on a shaft 35, which is also integral with the frame 30 or the infrastructure 20.

After having left the reel 31, strip 32 passes through a device 4 permitting the necessary fold ribs to be carried out, particularly those described above and referenced 10A, 11A, 12A, 13A, 14A, 15A, and 16C. The ribs provided for are made according to a known technique, by passage of the strip 32 between two rollers 40 and 41 equipped with the necessary contours. A device 5 permits the code or the date 19C to be affixed by imprinting on a portion of the blank. Device 5 comprises, according to a known technique, two rollers 50 and 51 between which the strip 32 passes. One of the rollers, e.g., the roller 51, comprises a mechanism for imprinting in relief or by inking, while the other roller, the roller 50, serves as a support roller. The milled lines previously marked by 17, 18, and 19 are carried out by a milling device 6 composed of two milling rollers 60 and 61 known per se.

A device 7 is intended first of all to place the tear string or tape 19B on one face of the strip 32 and then to carry out the cuts and partial cuts mentioned previously and marked as 14, 15, 16, 16B, and 18A. The tear string or tape 19B is pre-gummed in order to adhere to the strip 32 when acted upon by the pressure exerted by the roller 70 on the roller 72. A guide roller 71 permits the strip of paper 32 to be guided so that the angle it forms relative to the tear string or tape 19B when they meet may be as small as possible. The necessary cuts and precuts are carried out by a cutting roller 73 which is provided with a cutting mechanism known in the art, the roller 72 serving as a support roller. The U-shaped cut permitting the other tearing tongue 19A to be formed is made on a second pair of rollers 74 and 75.

At this stage of manufacture, the blanks 1 are always attached in the form of a strip 32, each strip portion corresponding to a blank 1 including all the necessary ribs, cuts, and precuts, as well as the milled lines. It only remains to carry out a transverse cut across the strip 32 in order to separate each blank 1. For this purpose, there is a cutting roller 77 resting on a support roller 76. The cutting blade mounted on the roller 77 is provided with a notch in order not to cut also the tongue 19A which projects from one edge of the blank 1. The cutting rollers 76 and 77 could be integrated with the other devices within the infrastructure 20 of the preparation device, but according to a preferential embodiment, these last cutting rollers 76 and 77 are separate from the device for reasons of synchronism, as will be explained below. As soon as the blanks 1 are separated from one another and no longer form a continuous strip, routing mechanisms diagrammed at 36 carry each blank 1 in order for it to be made into a cigarette pack wrapping on the rest of the packing machine 3.

By gathering in a relatively compact infrastructure 20 of the different mechanisms permitting the operations described above for preparation of a blank 1 to be carried out, it is possible to simplify the controls for advancing the strip of paper 32 at the time of the various preparation operations, as well as to simplify the synchronization of the various devices described. For this purpose, a movement control 8, proportional to the speed of operation of the packing machine 3, is transmitted directly to the various devices 4, 5, 6, and 7 mentioned, as is seen in FIG. 2. This transmission of movement and synchronization of the various elementary devices is preferably essentially or solely of mechanical type, e.g., by notched belt. It is obvious that such a control is much simpler than an individual electronic control of each device.

It is necessary that the separation of the blanks from the strip 32 by the cutting roller 77 occur at a very precise location of the strip 32 since the tolerance of position of this transverse cutting line is only 1 or 2 tenths of a mm. For this purpose, it is necessary to adjust the position of the strip 32 before carrying out a blank-separation cut.

The devic provided for this purpose will now be described. It is noted in FIG. 2 that the roller 41 comprises a flat 42, and likewise it has been mentioned previously that the grooves 10A and the milled line 19 do not cover the whole length of the blank. First, both the rollers 40 and 41 effecting particularly the longitudinal grooves 10A and the milling rollers 60 and 61 effecting particularly the milled line 19 are wedged or chocked so that the strip 32 is at the same time opposite both the flat 42 and the non-milled part of the milling rollers 60 and 61 when the portion of the strip intended to be cut by the cutting roller 77 is approximately opposite the cutting roller 77. Second, the action of the rollers 50 and 51, 72 and 73, 74 and 75 is periodic and does not act on the strip 32 at this moment. Accordingly, a slackening of the tension of traction imposed on the strip 32 is obtained. At this moment, the strip 32 is held solely by the braking imposed upon the reel 31 and is then being driven by the driving rollers 80. The strip 32 includes a pre-printed mark 19D at any location, and, if possible, at a location not visible when the pack is finished. The position of mark 19D is very exactly determined and can be detected by a reading cell 81, e.g., a photoelectric cell. When the cell 81 detects the passage of the mark 19D, the tension on the strip being slackened, cell 81 transmits a signal to control mechanism 82 which then controls the instantaneous driving speed of the rollers 80 as well as the action of the cutting roller 77. In this way, no shifting can be cumulated, and the transverse cut for separating the blanks always occurs at a very exactly determined distance from the mark 19D. Thus, control mechanism 82 is capable of controlling the action of transverse cutting rollers 76, 77 for separating the blank 1 from the strip of paper 32 at the time of the slackening of tension.

As shown in FIG. 2, the cutting rollers 76 and 77 permitting the transverse separation cut are preferably separate from the preparation device 2, but can be integrated therein.

Although the device 2 for preparing blanks has been described for the preparation of a specific embodiment of a blank, it is well understood that one skilled in the art will be able to adapt the device according to the desired embodiment of the blank. In particular, it is not necessary for all the elementary devices to be present, e.g., if it is not necessary to inscribe a code or a date, the respective device 5 may be omitted. Likewise, if the milled lines 17 are not foreseen, or else if a single mechanism of opening the pack is desired, the devices 6 and 7 for making the other opening mechanism are to be eliminated. Similarly, if the fold grooves are not desired, device 4 can be eliminated. At a minimum, the device for preparing blanks preferably includes the rollers of device 7 necessary for making the cuts 14,15, and possibly 16, the other elements being optional. Seeing that the device is fed by a strip of paper, the cutting device 76, 77, too, is required, but as has been seen previously, it is generally disposed on the packing machine itself. Likewise, the described sequence of the various elementary devices may be changed, it being understood that the cutting device 76, 77 must always be at the end of the line.

Thus, the device described, which may be mounted on a new packing machine or on an existing machine, particularly permits the concept of the packing machine to be simplified, and it becomes possible to obtain a large variety of embodiments of blanks through quick adaptations of the preparation device. The simplification of the drive of this device permits high-speed operation of the packing machine.

This device makes it possible in particular to obtain blanks of which the cuts and the fold lines are conceived and disposed in such a way that a package made up of a single layer of material and nevertheless having high fluid-tightness can be obtained.

Many modifications, substitutions and improvements may be apparent to the skilled artisan without departing from the spirit and scope of the present invention as described and defined herein and in the following claims.

We claim:

1. An apparatus for preparing single packaging blanks from a strip of connected packaging blanks wound around a center and mounted upon a rotatable reel, each blank having a separation point and a marker at a distance from the separation point, the apparatus comprising:

at least one rotatable mount having a tensioner and defining a starting point for a passage for the strip to follow, at least one pair of nip rollers downstream from the at least one rotatable mount, said pair of nip rollers providing controlled periodic tension on the strip, at least one controllable drive roller downstream from said pair of nip rollers, at least one sensor along the path for sensing the marker, at least one cutter downstream from said drive roller, and a controller for determining the location of the mark and separation point, and when the marker is at a preselected location, reducing for a period of time the tension applied by the pair of nip rollers, driving the drive roller at a controlled speed during that period of time, and actuating the cutter synchronous to the controlled speed during that period of time such that the strip is severed precisely at the separation point while the strip is being advanced by the drive roller.

2. An apparatus according to claim 1, wherein at least one nip roller is formed with a flat in its periphery, thereby periodically reducing tension when the flat is parallel with the passage.

3. An apparatus as claimed in claim 2, wherein the milling rollers have non-milled portions on their periphery, thereby periodically reducing tension when the flat is parallel with the passage.

4. An apparatus as claimed in claim 1, wherein the cutter is a rotating blade.

5. An apparatus as claimed in claim 4, wherein the rotating blade is a cutting roller.

6. An apparatus as claimed in claim 5, wherein the passage passes between the cutting roller and a pressure roller.

7. An apparatus as claimed in claim 1, wherein the nip rollers are milling rollers.

* * * * *